US006732449B2

(12) United States Patent
Evanyk

(10) Patent No.: US 6,732,449 B2
(45) Date of Patent: May 11, 2004

(54) DRYER/BLOWER APPLIANCE WITH EFFICIENT WASTE HEAT DISSIPATION

(76) Inventor: Walter Evanyk, 3200 Sherrye Dr., Plano, TX (US) 75074

( * ) Notice: Subject to any disclaimer, the term of this patent is extended or adjusted under 35 U.S.C. 154(b) by 0 days.

(21) Appl. No.: 10/410,978

(22) Filed: Apr. 9, 2003

(65) Prior Publication Data

US 2003/0192194 A1 Oct. 16, 2003

Related U.S. Application Data

(60) Continuation-in-part of application No. 10/117,776, filed on Apr. 4, 2002, which is a division of application No. 09/662,860, filed on Sep. 15, 2000, now Pat. No. 6,449,870.

(51) Int. Cl.[7] ..... A45D 20/00

(52) U.S. Cl. ..... 34/96; 34/97; 392/384; 392/385

(58) Field of Search ..... 34/96, 97; 392/360, 392/363, 364, 365, 366, 367, 368, 369, 373, 374, 379, 380, 383, 384, 381, 382; 219/476, 480

(56) References Cited

U.S. PATENT DOCUMENTS

| | | | |
|---|---|---|---|
| 3,651,413 | A | 3/1972 | Wycoff |
| 3,947,659 | A | 3/1976 | Ono |
| 4,132,360 | A | 1/1979 | Lee, Jr. |
| 4,195,217 | A | 3/1980 | Moller et al. |
| 4,267,914 | A | 5/1981 | Saar |
| 4,391,047 | A | 7/1983 | Janssens et al. |
| 4,571,588 | A | 2/1986 | Lee et al. |
| 4,576,553 | A | 3/1986 | Winston et al. |
| 4,605,019 | A | 8/1986 | Reynolds et al. |
| 4,755,792 | A | 7/1988 | Pezzolo et al. |
| 4,757,183 | A | 7/1988 | Karey et al. |
| 4,848,007 | A | 7/1989 | Montagnino |
| 4,893,067 | A | 1/1990 | Bhagwat et al. |
| 4,939,345 | A | 7/1990 | Farina et al. |
| 5,054,211 | A | 10/1991 | Shulman |
| 5,060,398 | A | 10/1991 | Wolens |
| 5,086,526 | A | 2/1992 | Van Marcke |
| 5,122,427 | A | 6/1992 | Flowers et al. |
| 5,155,925 | A | 10/1992 | Choi |

(List continued on next page.)

*Primary Examiner*—Jiping Lu
(74) *Attorney, Agent, or Firm*—Jones Day

(57) ABSTRACT

The present invention relates to a blower dryer appliance typically used for drying and styling hair. When electrically activated, these appliances virtually always route electrical power to the fan or blower motor prior to or simultaneously with the heating element(s). Semiconducting switching devices used for regulating, controlling and/or switching electrical power generate waste heat that must be dissipated. Typically, heat is conducted and/or channeled away from the semiconducting switching device through a heat sink which is thermodynamic-mechanically coupled to the device. The greater the coverage area of the heat sink, the more waste heat can be dissipated depending on the ability of the heat sink to make contact with cooler, ambient air. This adds costs to the dryer/blower for engineering the heat sink, cost of the sink itself, and necessary design changes in the dryer/blower for accommodating the sink. The presently disclosed invention utilizes the inherent characteristics of the dryer/blower for channeling and reusing waste heat generated from an active switching device by positioning the active device in the air path of the blower. Relocating the heat generation portion of the control circuitry to the air path has three major benefits: greater cooling effect for the switching transistor and therefore more efficient transistor conduction and switching operation; utilizing smaller and less costly heat sinks; and the cumulative effect of combining the waste heat generated by the switch to the intentional heat effect generated by heating element(s).

17 Claims, 3 Drawing Sheets

U.S. PATENT DOCUMENTS 5,157,757 A 10/1992 McDougall
5,161,317 A 11/1992 McDougall
5,195,253 A 3/1993 Poumey et al.
5,275,339 A 1/1994 Andis et al.
5,277,261 A 1/1994 Sakoh
5,289,885 A 3/1994 Sakoh
5,298,821 A 3/1994 Michel
D345,727 S 4/1994 Flowers et al.
5,392,528 A 2/1995 McDougall
5,394,620 A 3/1995 Chimera
5,410,229 A 4/1995 Sebastian et al.
5,434,946 A 7/1995 Barzilai et al.
5,440,215 A 8/1995 Gilmore
5,467,540 A 11/1995 Bastien
5,471,763 A 12/1995 McArthur
5,473,824 A 12/1995 Prehodka
D369,434 S 4/1996 LeCompte, Sr.
5,526,460 A 6/1996 DeFrancesco et al.
5,555,637 A 9/1996 Montagnino
5,583,730 A * 12/1996 Gershen et al. ..... 361/50
5,651,190 A 7/1997 Sanders
5,701,681 A 12/1997 Wonka et al.
5,720,107 A 2/1998 Rolf et al.
5,725,159 A 3/1998 Dorber et al.
5,731,673 A 3/1998 Gilmore
5,787,601 A 8/1998 Stelly
5,857,262 A 1/1999 Bonnema et al.
5,873,178 A 2/1999 Johnson
5,884,008 A 3/1999 Goldberg
5,937,622 A 8/1999 Carrier et al.
5,940,980 A 8/1999 Lee et al.
5,943,712 A 8/1999 Van Marcke
5,945,803 A 8/1999 Brotto et al.
6,010,228 A 1/2000 Blackman et al.
6,178,572 B1 1/2001 Van Marcke
6,242,889 B1 6/2001 Belyo
6,286,609 B1 9/2001 Carrier et al.
6,296,065 B1 10/2001 Carrier
6,353,705 B1 3/2002 Capps et al.
6,406,168 B1 6/2002 Whiting
6,424,799 B1 7/2002 Gilmore
6,449,870 B1 9/2002 Perez et al.
6,460,626 B2 10/2002 Carrier
6,479,958 B1 11/2002 Thompson et al.
6,538,403 B2 3/2003 Gorti et al.

* cited by examiner

DRYER/BLOWER APPLIANCE WITH EFFICIENT WASTE HEAT DISSIPATION

CROSS REFERENCES TO RELATED APPLICATIONS

The present application is a continuation in part of and claims priority from the following co-pending U.S. patent applications:

U.S. patent application entitled "Portable Hair Dryer" having application Ser. No. 10/117,776 filed on Apr. 4, 2002, currently pending, which is a divisional of Ser. No. 09/662,860, now U.S. Pat. No. 6,449,870 entitled "Portable Hair Dryer" and filed on Sep. 15, 2000. The above-identified applications are incorporated by reference herein in their entirety.

BACKGROUND OF THE INVENTION

1. Field of the Invention

The present invention is generally related to a combination dryer and blower appliance. More specifically, the present invention is related to control circuitry for controlling the electrical components of a dryer/blower.

2. Description of Related Art

There are many different types of hair dryers/blowers. For instance, typical hair dryers are shown in U.S. Pat. Nos. 4,195,217; 5,555,637; and 5,701,681. All of them, however, have AC cords attached and are not portable and self-contained. U.S. Pat. No. 6,449,870 entitled "Portable Hair Dryer" and by the inventor of the present invention discloses a portable dryer/blower appliance which uses an optional battery for its power supply.

Typically, prior art appliances of the type identified above have made use of a mechanical contact switch or switches for controlling the electrical power to the heating element(s) and blower motor. In general, these switches are fairly efficient as they do not generate any appreciable waste heat while conducting electricity. Any minimal waste heat that is generated by the switch while it is conducting is of such low intensity that it can easily be dissipated through the body of the dryer/blower without the need for extensively modifying the appliance, or even considering the switch heat in the initial design stages.

As mentioned, switches in prior art appliances typically consist of only the mechanical contact type due to several factors, the preeminent factor being the manufacturing costs associated with direct current (DC) operation. However, dryer/blower appliances have been recently introduced which use active devices for their switching capabilities, such as CMOS transistors and the like. Typically, this requires that the electrical power be converted from alternating current (AC) to DC, or alternatively, to elaborate mirror circuits for controlling the respective positive and negative portions of the AC power cycle.

Power transistors, unlike mechanical contact switches, can generate substantially more waste heat that must be dissipated (depending on the characteristics of the particular transistor type). Failure to properly channel the waste heat away from the device will often degrade its performance, making it less conductive, resulting in more waste heat which is not channeled away from the device, more inefficiency, and eventually causing the device to fail due to overheating (this is referred to as the "heat avalanche effect"). Additionally, certain semiconductor switching devices generate proportionally more heat as a result of changing states from insulator to conductor than from conducting electricity alone. Therefore, again depending on the characteristics of the individual transistor type selected for use, pulsing circuits using these devices potentially generate even more waste heat than devices employed for merely switching the electrical power to the electrical components of the dryer/blower "on" and "off."

SUMMARY OF THE INVENTION

The present invention relates to a blower dryer appliance typically used for drying and styling hair. When electrically activated, these appliances virtually always route electrical power to the fan or blower motor prior to or simultaneously with the heating element(s). Semiconducting switching devices are used for regulating, controlling and/or switching electrical power generated from waste heat that must be dissipated. Typically, heat is conducted and/or channeled away from the semiconducting switching device through a heat sink which is thermodynamically and mechanically coupled to the device. The greater the coverage area of the heat sink, the more waste heat can be dissipated depending on the ability of the heat sink to make contact with cooler, ambient air. This adds costs to the dryer/blower for engineering the heat sink, cost of the sink itself, and necessary design changes dryer/blower for accommodating the sink. The presently disclosed invention utilizes the inherent characteristics of the dryer/blower for channeling and reusing waste heat generated from an active switching device by positioning the active device in the air path of the blower. Relocating the heat generation portion of the control circuitry to the air path has three major benefits: greater cooling effect for the switching transistor and therefore more efficient transistor conduction and switching operation; utilizing smaller and less costly heat sinks; and the cumulative effect of combining the waste heat generated by the switch to the intentional heat effect generated by the heating element(s).

BRIEF DESCRIPTION OF THE DRAWINGS

The novel features believed characteristic of the present invention are set forth in the appended claims. However, the invention itself, as well as a preferred mode of use, further objectives and advantages thereof, will be best understood by reference to the following detailed description of an illustrative embodiment when read in conjunction with the accompanying drawings wherein:

Other features of the present invention will be apparent from the accompanying drawings and from the following detailed description.

DETAILED DESCRIPTION OF THE INVENTION

Figure 1:
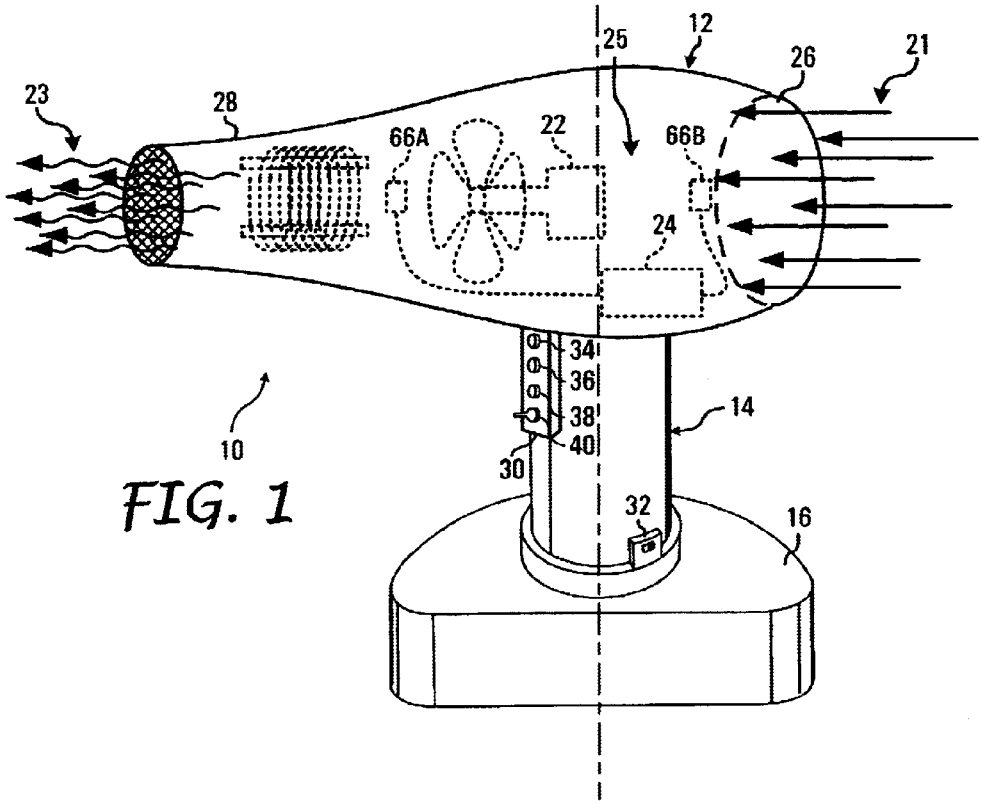
FIG. 1 is a perspective view of the novel hair dryer/blower in accordance with an exemplary embodiment of the present invention.

FIG. 1 is a perspective view of novel dryer and dryer appliance 10 useful for drying hair and the like, including elongated hollow body portion 12, handle portion 14 and battery base portion 16. It will be noted that mass center line 18 of each of elongated hollow body portion 12, handle 14, and battery base 16 are all in alignment, thus allowing unit 10 to be balanced and enabling the hair dryer/blower to stand alone on base 16. In addition, by the alignment of the mass center lines of elongated hollow body portion 12, handle 14 and base 16, and proper weight distribution of hollow body portion 12 and base 16, as can be done by those skilled in the art, balance is provided to enable the unit to be used with minimum strain on the arm and hand of the user.

Elongated hollow body portion 12 has one or more heating element(s) 20, blower motor 22 and circuit 24. Circuitry 24 may be of one or more types of circuitry including pulsing circuitry as disclosed in U.S. Pat. No. 6,449,870 entitled "Portable Hair Dryer" and incorporated by reference herein in its entirety. Circuitry 24 will also be described in somewhat more detail hereafter. Elongated hollow body portion 12 also has posterior end 26 and anterior or front end 28. Notice that air flow path 25 results from blower motor 22 being switched "on" which includes cool air 21 being drawn in at posterior end 26 and warm air 23 being exhausted at front end 28. Notice also that circuit component 66A and 66B are positioned in cool air 21 portion of air flow path 25, either before blower 22, i.e., circuit component 66A, or subsequent to blower 22, i.e., circuit component 66B, in air path 25. Circuit component 66A and 66B is further electrically coupled to circuit 24 as will be described below.

Handle 14 also has switch control pedestal 30 and mechanism 32, well known in the art, for locking battery/base unit 16 to handle 14. Switch pedestal 30 includes diode light 34, usually green in color, but may be of any desired color. Switch 36 (S1) controls power only to the blower motor and switch 38 (S2) controls power to both the blower motor and the heating element. Manual control switch 40, which will be explained in detail hereafter, has multiple positions such as low, medium and high that can be selected by the user to designate the heat desired to be produced by heating element 20. The weight of base 16 is in balance with the weight of elongated body portion 12. Such balance can be easily achieved by those skilled in the art.

Figure 2:
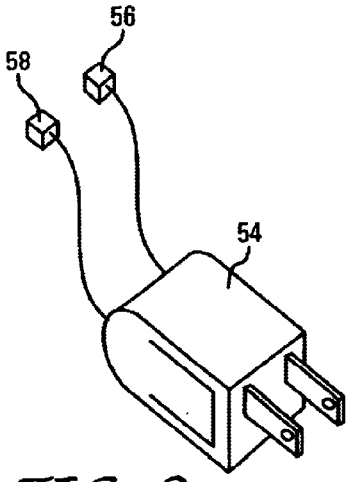
FIG. 2 is a schematic representation of a converter for supplying either AC or DC power to the battery for charging thereof and is a perspective view of the novel battery that can be attached to the dryer/blower as shown in FIG. 1 in accordance with an exemplary embodiment of the present invention.

Note in FIG. 2 that plug-in unit 54 could generate either AC or DC power output voltage on jacks 56 and 58. If the battery unit has its own rectifier unit, then jacks 56 and 58 in FIG. 2 may generate AC voltage. If a type of battery unit is selected that does not have a rectifier, then plug-in unit 54 may be an AC to DC converter and jacks 56 and 58 would generate DC voltage, or alternatively, a rectifier included in dryer and dryer appliance 10. As mentioned herein, typical prior art dryer/blower switches consist of only the mechanical contact type devices usually capable of switching either AC or DC power. Utilizing AC power was generally considered far more economical because the components of the appliance lent themselves to operation from AC power, usually available from an AC wall outlet. Thus, expensive power rectifying circuits were avoided, and so the manufacturing costs associated with direct current (DC) operation were lowered. However, dryer/blower appliances have been recently introduced which use active devices for their switching capabilities, for one reason or another (for example U.S. Pat. No. 6,449,870 for pulsing power to the heating element), which utilize semiconducting switching devices such as CMOS transistors and the like. Typically, the electrical power typically should be converted from alternating current (AC) to DC, or alternatively, the AC power should be divided into its respective positive and negative portions and each portion controlled by mirrored control circuits. Here it should be understood that exemplary embodiments of the present invention will be described herein with regard to the pulsing circuit disclosed in the U.S. Pat. No. 6,449,870. Those of ordinary skill in the art will readily recognize that the concepts and principles described herein could be applied to types of control circuitry other than pulsing circuits that control and influence electrical power in a variety of dryer/blower appliances. Furthermore, with the teaching of the present invention, the ordinary skilled artisan could easily modify those types of appliances with the presently described invention as taught herein.

Figure 3A:
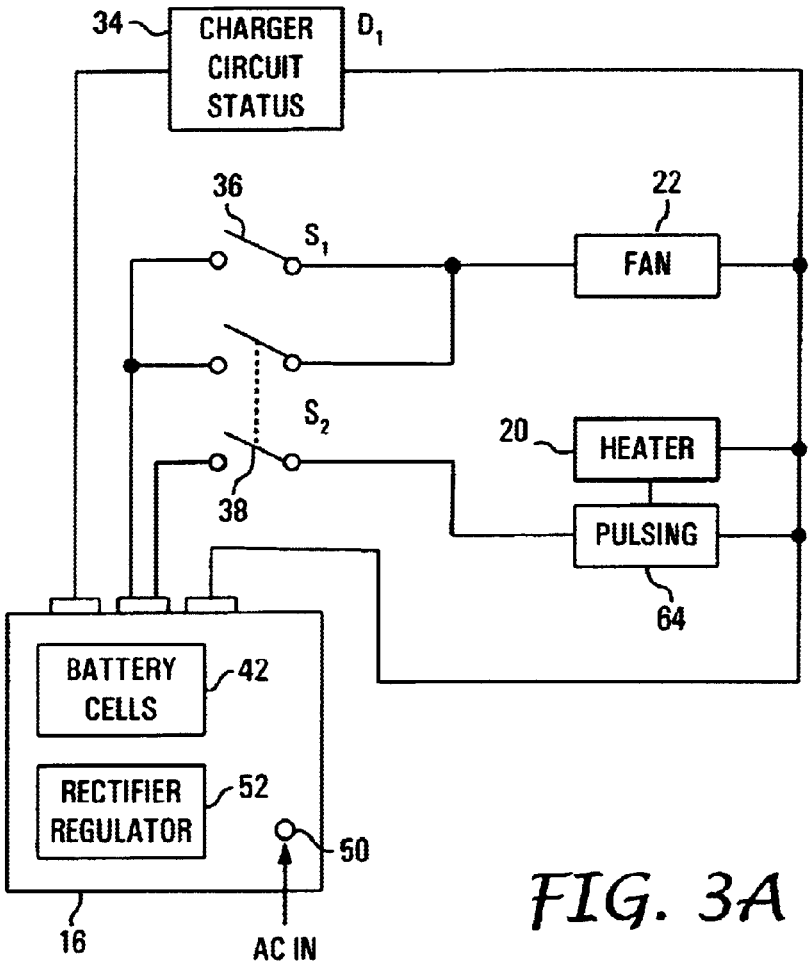
FIG. 3A is a block diagram of the control circuit for controlling the power to the blower fan and to the heating element in accordance with an exemplary embodiment of the present invention.

FIG. 3A discloses the basic electrical circuit for controlling power to the blower fan and to the heating element in accordance with an exemplary embodiment of the present invention. Basic circuit 62 includes the battery portion, if so configured, with the battery cells therein and, if desired, the rectifier unit. Optionally, it may also have a jack for connecting a charger thereto. When the unit is plugged into a power source, the power is immediately supplied to LED 34 which indicates that the battery has sufficient power to operate the unit. When switch button 36 (S1) is depressed, fan motor or blower 22 is operated alone. When switch 38 (S2) is closed, two sets of contacts are closed: one coupling power to fan 22 and the other coupling power to heating element 20 through pulsing circuit 64, if desired. The pulsing circuit 64 will be described hereafter. Alternatively, electrical power may be routed directly to circuit 64 and switch 36 (S1) and switch 38 (S2) is coupled to a micro current for controlling "switching voltages" circuit 64 (not shown). In accordance with that exemplary embodiment of the present invention, circuit 64 would control the power to heater 20 and fan 22 rather than to mechanical switches 36 (S1) and 38 (S2).

Figures 3B, 3C:
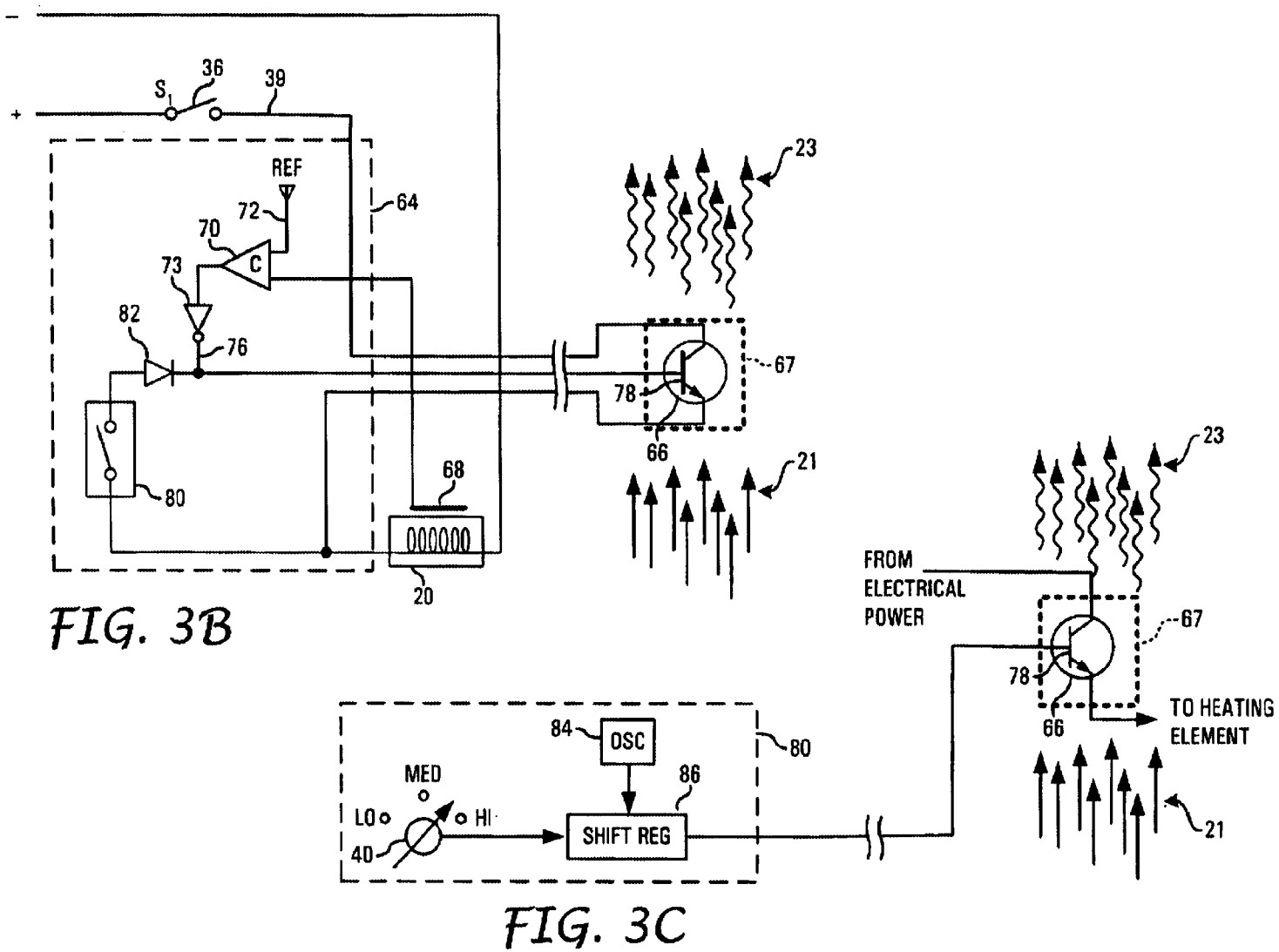
FIG. 3B is a circuit illustrating a one-circuit embodiment for quickly heating the heating element and then supplying pulsed current or voltage to maintain the heat while dissipating waste heat into the air path in accordance with an exemplary embodiment of the present invention.
FIG. 3C illustrates the details of the pulsing circuit illustrated in FIG. 3B with the active device of the circuit located remotely from the circuit for dissipating waste heat into the air path in accordance with an exemplary embodiment of the present invention.

With regard to the pulsing circuit embodiment, circuit 64 is shown in detail in FIG. 3B. When the unit is first turned on and switch 38 (S2) is depressed, both the heating element and the blower motor are energized and it is desired that the heating element heat as quickly as possible. Thus, as shown in FIG. 3B, when switch 38 is closed, conductor 39 is coupled directly to the input of transistor 66. The temperature of heating element 20 is monitored by a temperature sensor, such as a thermocouple or thermistor. Temperature sensor 68 is coupled to comparator 70. Another voltage reference 72 is coupled to the other input of the comparator representing the proper or maximum heating temperature of element 20. Since there is no heat at first, there is no output from comparator 70. That lack of signal is detected by inverting diode 73 which generates an output signal on line 76 that is coupled to base 78 of power transistor 66 causing it to conduct. Thus, full voltage is applied to heating element 20 to provide maximum heating in minimum time. As soon as the element is heated to the desired temperature, and that is sensed by sensor 68, an output signal is generated by comparator 70 that causes inverting diode 73 to remove its signal on output line 76, thus removing the continuous signal from base 78 of transistor 66. At this time, pulsing circuit 80, which is isolated from inverting diode 73 by isolating diode 82, provides pulses to the base 78 of transistor 66 to maintain the heat attained by heating element 20 without having a continuous voltage applied thereto.

However, rather than supporting transistor 66 locally on circuit 64, the transistor is located remote from the circuit. It is expected that transistor 66 will generate a substantial amount of waste heat during its operation. This heat, if not channeled away from circuit 64, will degrade the performances of both transistor 66 and other heat sensitive components on located on circuit 64. Therefore, transistor 66 is relocated from circuit 64 proximate to air path 25. In so doing, cool air drawn into air path 25 by blower 22 surrounds transistor 66 and takes on waste heat dissipated from transistor 66 and continues on as warm air 23. Thus, the operational life and efficiency of transistor 66 are increased, and the waste heat is added to air path 25 for use in drying, thereby lowering the heating burden on heat element 20. Optionally, heat sink 67 may be thermodynamically and mechanically coupled to transistor 66 which is consistent with a manner known to those of ordinary skill in the relevant art.

Returning to FIG. 1, notice that the transistor/optional heat sink component is depicted in one of two possible positions in air path 25, either before (component 66A), or after (component 66B) blower 22, but always being positioned in the air stream before heat element 20. In either of these locations, the heat generated by component 66A/66B is not merely exhausted into the ambient air, but is recycled as useful heat for supplementing the heat generated by heat element 20. The best location for the transistor/optional heat sink component will most likely be a function of the particular dryer/blower design, but vibration, electrical interference and cooling capacity should all be considered in selecting the precise location for the transistor/optional heat sink component. It is also expected that in certain situations, such as in an AC controlled embodiment, multiple transistor/optional heat sink components equivalent to one or both of component 66A/66B will be present, such as in AC operational control.

Pulsing circuit 64 is shown in detail in FIG. 4B. When the unit is first turned on and switch 36 ($S_1$) is depressed, the heating element is energized and it is desired that the heating element heat as quickly as possible. Thus, as shown in FIG. 4B, when switch 38 is closed, conductor 39 is coupled directly to the input of transistor 66. The temperature of heating element 20 is monitored by a temperature sensor, such as a thermocouple or thermistor. Temperature sensor 68 is coupled to comparator 70. Another voltage reference 72 is coupled to the other input of the comparator representing the proper or maximum heating temperature of element 20. Since there is no heat at first, there is no output from comparator 70. That lack of signal is detected by inverting diode 73 which generates an output signal on line 76 that is coupled to base 78 of power transistor 66 causing it to conduct. Transistor 66 is turned on by the signal on output line 76. Thus, full voltage is applied to heating element 20 to provide maximum heating in minimum time. As soon as the element is heated to the desired temperature and is sensed by sensor 68, an output signal is generated by comparator 70 that causes inverting diode 73 to remove its signal on output line 76, thus removing the continuous signal from the base 78 of transistor 66. At this time, pulser circuit 80, which is isolated from inverting diode 73 by isolating diode 82, provides pulses to base 78 of transistor 66 to maintain the heat attained by heating element 20 without having a continuous voltage applied thereto.

Pulser circuit 80 is shown in detail in FIG. 3C in accordance with one exemplary embodiment of the present invention. Oscillator 84 applies pulses to circuit 86 that could be a shift register, a timer, a counter, or a divider circuit as shown in U.S. Pat. No. 4,571,588, which is incorporated herein by reference in its entirety. The duty cycle is the percentage of time a unit is used or the ratio of operation time to shutdown time. If a device capable of only fixed length pulses is used for controlling the duty cycle, then the ratio can be adjusted only by designating more or less pulses as operation pulses. If, however, the period of the pulses can also be altered, then the duty cycle can be altered by either increasing the ratio of the operation pulses to shutdown pulses, or by lengthening the duration of the operation pulses in the cycle. Thus, selecting a device having output pulse width modulation capability allows for adjusting the duration of the operation period as well as the ratio of operation periods. Many types of times and shift registers known in the art have pulse width modulation capabilities. In accordance with one exemplary embodiment, circuit 86 may be a 4-bit shift register as depicted in FIG. 3C. Input switch 40 is used for selecting select low, medium and high heat causing a selected bit from one stage of circuit 86 to be connected to base 78 of transistor 66 thus causing transistor 66 to be pulsed on and off at a given rate. An example is illustrated in FIG. 5D of the U.S. Pat. No. 4,571,588 and is not reproduced herein.

While the present invention has been described with reference to an exemplary DC-powered dryer/blower appliance which utilizes pulsing circuitry for minimizing power consumption, one of ordinary skill level in the relevant art would readily understand that the principles and concepts discussed herein are equally relevant for other types of appliances. One such appliance is an AC-powered dryer/blower appliance, as alluded to above, in which circuit component 66A, and/or, circuit component 66B may be comprised, at least partially, of heat generating solid state devices, e.g. thyristors, sometimes referred to as silicon controlled rectifiers (SRCs), more modern gate turn off (GTO) thyristors and triacs, a complementary thyristor structure suitable to control AC power, which are all well known and their uses are well understood by those of ordinary skill in the relevant art. In accordance with an exemplary embodiment of the present invention, circuit 24 provides gate control, for turning "on" and "off" the heat generating devices of circuit component 66A, and/or, circuit component 66B, e.g. for sending a positive pulse current to a GTO thyristor for "on" condition and a negative pulse current to GTO thyristor gate circuit for "off" condition. The techniques described herein with regard to the present invention may be incorporated in the AC active switching device of such an AC powered appliance. Additionally, and as alluded to above, the techniques described herein with regard to the present invention may be incorporated in the DC active switching device for a DC powered appliance, such as a battery operated portable dryer/blower appliance.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A dryer/blower appliance with efficient waste heat dissipation comprising:

a hollow body portion having a substantially open first end and a substantially open second end, and an interior cavity disposed within the hollow body portion;

a blower, said blower comprising a fan and a motor, said blower disposed substantially within the interior cavity of the hollow body portion;

at least one heating element disposed substantially within the interior cavity of the hollow body portion;

switch controls electrically coupled between said blower motor and a power source, and further between said heating element and said power source, wherein said switch controls selectively cause an interruption of power to at least one of said blower motor and said heating element;

an air flow path across at least a portion of the interior cavity of the hollow body portion, said air flow path beginning at the first end and ending at the second end of the hollow body portion;

a circuit at least partially disposed within the interior cavity of the hollow body portion; and a heat generating electrical switching component, said heat generating electrical switching component electrically coupled to said circuit and disposed within the interior cavity of the hollow body portion directly in a path of the air flow path across at least a portion of the interior cavity.

2. The dryer/blower appliance recited in claim 1 above, wherein said circuit is a pulsing circuit further comprising a circuit for supplying unmodulated power to said heating element.

3. The dryer/blower appliance recited in claim 2 above, wherein the heat generating electrical switching component is electrically positioned in the air flow path in a position in the interior cavity of the hollow body portion between the fan and one of the first end and the second end.

4. The dryer/blower appliance recited in claim 3 above, wherein said circuit for supplying unmodulated power comprises:

a sensor for sensing a heating element temperature and generating a corresponding signal; and a comparator for comparing a reference signal to said sensed signal and providing a first output.

5. The dryer/blower appliance recited in claim 4 above, wherein said heat generating electrical switching component is a power transistor electrically coupled between said power source and said heating element, said power transistor further having a trigger electrically coupled to said comparator, wherein said power transistor provides un-modulated power to said heating element based on the first output.

6. The dryer/blower appliance recited in claim 1 above, wherein said circuit is a switching circuit and the heat generating electrical switching component supplies power to said heating element.

7. The dryer/blower appliance recited in claim 1 above, further comprises:

a heat sink thermodynamically and mechanically coupled to the heat generating electrical switching component.

8. The dryer/blower appliance recited in claim 1 above, wherein the heat generating electrical switching component is electrically positioned in the air flow path in a position in the interior cavity of the hollow body portion between the first end and the fan.

9. The dryer/blower appliance recited in claim 1 above, wherein the heat generating electrical switching component is electrically positioned in the air flow path in a position in the interior cavity of the hollow body portion between the second end and the fan.

10. The dryer/blower appliance recited in claim 1 above, wherein the heat generating electrical switching component is electrically positioned in the air flow path in a position in the interior cavity of the hollow body portion between the fan and one of the first end and the second end.

11. The dryer/blower appliance recited in claim 1 above, wherein said heat generating electrical switching component is a power transistor which further comprises:

a power transistor having an input electrically coupled to said power source, an output electrically coupled to said heating element and a trigger; and a pulser circuit electrically connected to said trigger of said power transistor for providing output pulses to said trigger of said power transistor at an on/off rate for providing modulated power to said heating element based on the output pulses.

12. The dryer/blower appliance recited in claim 11 above, further comprises a manual control coupled to said pulser circuit for setting a desired on/off rate for providing modulated power to said heating element.

13. The dryer/blower appliance recited in claim 11 above, wherein said circuit divides said power into a substantially positive electrical power component and a substantially negative electrical power component, and said heat generating electrical switching component provides one of said substantially positive electrical power component and said substantially negative electrical power component to said heating element.

14. The dryer/blower appliance recited in claim 13 above, further comprises:

a second heat generating electrical switching component, said second heat generating electrical switching component provides the other of said substantially positive electrical power component and said substantially negative electrical power component to said heating element.

15. The dryer/blower appliance recited in claim 1 above, wherein said heat generating electrical switching component being positioned in said air flow path as to provide a minimal restriction to an amount of air flow for an amount of waste heat transfer into said air flow path.

16. The dryer/blower appliance recited in claim 1 above, wherein said heat generating electrical switching component is an active solid state device for controlling one of alternating current (AC) and direct current (DC).

17. The dryer/blower appliance recited in claim 16 above, wherein said heat generating electrical switching component comprises one of a diode, a transistor, a thyristor, and a triac.

* * * * *